US005167333A

United States Patent [19]

Hawryszkow et al.

[11] Patent Number: 5,167,333

[45] Date of Patent: Dec. 1, 1992

[54] APPARATUS TO PREVENT DETRIMENTAL EXTRANEOUS FOREIGN MATTER FROM ENTERING A CAVITY FORMED AT AN OUTER END OF A FEMALE CONNECTION MEMBER OF AN ARTICULATED COUPLING

[75] Inventors: Michael G. Hawryszkow, Munster, Ind.; William D. Wallace, Chicago, Ill.; David W. Daugherty, Jr., Bolingbrook, Ill.; Wajih Kanjo, Lockport, Ill.

[73] Assignee: Westinghouse Air Brake Company, Wilmerding, Pa.

[21] Appl. No.: 588,164

[22] Filed: Sep. 26, 1990

[51] Int. Cl.[5] ..... B61G 7/14

[52] U.S. Cl. ..... 213/1 R; 105/458

[58] Field of Search ..... 105/3, 4.1, 8.1, 458, 105/459; 213/1 R

[56] References Cited

U.S. PATENT DOCUMENTS

| | | | |
|---|---|---|---|
| 1,754,111 | 4/1930 | Latshaw | 105/3 X |
| 3,025,973 | 3/1960 | Shafer | 213/1 R |
| 4,240,559 | 12/1980 | Nicholson | 213/1 R |
| 4,258,628 | 3/1981 | Altherr | 105/4 R |
| 4,593,829 | 6/1986 | Altherr | 213/75 R |
| 4,867,071 | 9/1989 | Weber | 105/4.1 |

OTHER PUBLICATIONS

Maintenance Manual for ASF Articulated Connection Assembly.

*Primary Examiner*—Robert J. Oberleitner
*Assistant Examiner*—Kevin D. Rutherford
*Attorney, Agent, or Firm*—J. O. Ray, Jr.

[57] ABSTRACT

A shroud apparatus is provided to substantially minimize detrimental foreign matter entering into a predetermined portion of a cavity disposed at the outer end of a female connection member that receives therein the outer end of a male connection member of an articulated coupling arrangement used to connect adjacent ends of a pair of railway cars together in a semi-permanent manner. Such shroud apparatus includes a plate-like member that is positionable above and engageable with the articulated coupling arrangement in a location which will substantially prevent such foreign matter entering such cavity. The plate-like member has a predetermined size and shape such that when such shroud apparatus is viewed from the top of such articulated coupling arrangement all openings to the predetermined portion of such cavity will appear to be covered. A shroud securing device is provided which engages both the plate-like member and the articulated coupling arrangement to removably secure such shroud apparatus to a predetermined member of the articulated coupling arrangement.

16 Claims, 3 Drawing Sheets

APPARATUS TO PREVENT DETRIMENTAL EXTRANEOUS FOREIGN MATTER FROM ENTERING A CAVITY FORMED AT AN OUTER END OF A FEMALE CONNECTION MEMBER OF AN ARTICULATED COUPLING

FIELD OF THE INVENTION

The present invention relates, in general, to articulated coupling arrangements which are used to connect one end of a first railway car body to an adjacent end of a second railway car body, in a substantially semi-permanent manner and, more particularly, this invention relates to an apparatus which will prevent detrimental extraneous foreign material from entering into the cavity located adjacent an outer end of a female connection member of an articulated coupling arrangement.

BACKGROUND OF THE INVENTION

As is well known, in the railroad industry, coupling devices have been used extensively for a great many years to connect the adjacent ends of a pair of railway cars together to form a train consist of several individual cars. It is equally well known that on those railway cars which will be used in interchange service, the coupling devices used must receive approval by the Association of American Railroads before they can be installed for service on such railway cars. In this railroad application, it has come to be quite well known that these coupling devices generally perform a number of functions which are of importance. Obviously, one of the important functions performed by the standard railway coupling device is that it facilitates both the connection and the disconnection of individual railway cars to and from, respectively, a train consist. Another function of importance, with respect to such standard railway coupling device, is that it will enable such railway cars to successfully negotiate the various curved portions of the track structure which are normally encountered during operation of the train consist. Additionally, these coupling devices are designed to permit a number of individual railway cars to be readily and easily combined so that a train consist can be formed. Further, these coupling devices enable such railway cars to be easily separated into individual cars again for the purpose of either loading or unloading cargo thereto or therefrom, respectively, as required. This feature permits a railroad to leave a particular railroad car at a customer's plant while they are either delivering or picking up other cars located at other locations. The problem of extraneous foreign material, solved by the present invention, is not present in this standard coupling device because the mating connecting components are all disposed in a substantially vertical direction and, therefore, would not retain such foreign material.

In the more recent past, however, the railroad industry has come to recognize that there are a number of rather significant advantages which can be achieved by the interconnection of several railway cars together in a manner which will form a generally semi-permanent unit. This is particularly the case, for example, where such individual railway cars are adapted for use in what has come to be commonly known in the railway industry as "piggyback" or intermodal service. One of the primary reasons for this is that the cargo to be either loaded or unloaded is brought to or removed from, respectively, a central location. In general, these central cargo handling locations are owned and operated by the railroad handling the cargo. This cargo, generally, is over-the-road trailers or rather large containers such as containers used to ship cargo by ocean going vessels. The individual railway cars which have been connected together in such substantially semi-permanent fashion are commonly known in the railroad industry as either a "5-pack" or "10-pack".

Regardless of whether a 5-pack or a 10-pack unit is being used, it will not require the use of these standard couplers, except at the outer end of each unit. One of the primary reasons why such standard coupling devices are not required, in this application, is that in view of their dedicated-type service, these 5-pack or 10-pack units will normally only be broken on a periodic basis. Generally, for example, the breaking of these units will only take place when maintenance must be carried out on an individual coupler component or on some other critical component positioned on such railway cars which requires such railway cars to be taken out of service at least temporarily. The coupling device used intermediate the outer ends of the cars making up these 5-pack and/or 10-pack units are most commonly known in the railroad industry as articulated couplers. It is such articulated couplers where the problem solved by the present invention exists as will become clear as the description proceeds.

Nevertheless, it has become evident to the railroad industry that with the use of this articulated coupling arrangement, it is possible for them to achieve a significant reduction in their operating and equipment costs. This cost reduction can be attributed to a variety of reasons. These reasons include, for example, lower equipment weight which results in enhanced energy savings. In addition, fewer railway car trucks are required with the articulated coupling arrangement which results in both lower equipment cost as well as a significant reduction in maintenance requirements. Further, draft gear is only required behind the standard coupling device located on the extreme outer ends of such 5-pack and 10-pack unit. Such reduction in the number of draft gears required, like the reduction in the number of railway car trucks, result in lower equipment and lower maintenance costs.

At the present time, however, with the relatively extensive use of such substantially semi-permanent coupling arrangements, the railroad industry, in conjunction with the railway equipment supplier, has determined that it is of critical importance for a close-buttoned relationship to be maintained between the coupler draft components which are normally present in a particular articulated-type coupling arrangement. Further, contributing to such importance of this close-buttoned relationship requirement is the ever increasing loads which must be carried by the modern railway cars and train consists. Such heavier loads being necessary so that such railway industry can remain competitive with other forms of cargo distribution. This close-buttoned relationship has been found necessary, for example, so that the detrimental effects of the impact forces which are normally encountered during in-track operation of the train consist can be reduced and maintained at an acceptable level. In this manner, the possible damage that could be incurred not only to the cargo, but also to the railway equipment can be held to an absolute minimum. Such impact forces will normally be encountered during the normal buff operation of such train consist.

With the above discussion in mind, attention is now directed to a particular well known prior art type articulated coupling arrangement which is used for the purpose of connecting adjacent ends of a pair of railway cars together in such semi-permanent fashion. This prior art articulated coupling arrangement is taught in U.S. Pat. No. 4,258,628. As has been generally illustrated therein, this particular articulated coupling arrangement includes a male connection member and a female connection member. In this coupling arrangement, the male connection member is secured to one end of a first railway car body member and the female connection member is secured to one end of a second railway car body member, such that the male connection member is horizontally insertable into a cavity within the female connection member and such male and female connection members are joined together with clearance sufficient to permit pivotal movement of one component with respect to the other and, The female connection member, in this articulated coupling arrangement, is positioned for rotation within a center plate bowl portion located on the upper surface of a bolster member positioned intermediate a pair of side frame members of a railway car truck member. Such rotatable-type connection of such female connection member in the center plate bowl portion is accomplished in a manner that is generally well recognized in the railway art and for that reason will not be discussed in any further detail. The outer end portion of the male connection member is disposed for relative movement within a cavity located at the outer end portion of the female connection member. A pin member, positioned in a vertical plane, is utilized in this prior art articulated coupling arrangement to connect such outer end portion of the male connection member within such cavity at such outer end of the female connection member together and thereby form such substantially semi-permanent coupling.

It can be seen that the rear surface portion of the aperture formed in such male connection member which will receive the pin member therein includes a horizontally disposed concave configuration and a vertically disposed convex configuration. This particular aperture configuration is desirable in this articulated coupling arrangement in order for both the male connection member and the female connection member to be able to move in each of the necessary horizontal direction and the vertical direction with respect to one another during operation on a track structure.

Such male connection member, adjacent the outer end surface of the outer end portion thereof, includes a convex configuration which abuttingly engages a complimentary concave surface that is formed on the front face of a follower member. As illustrated in the drawings for this articulated coupling arrangement, the follower member is disposed within the rear portion of the cavity located in the outer end portion of such female connection member. On the rear face portion thereof, this follower member includes a pair of vertically disposed slot-like cavities formed therein.

A first portion of a resilient member is positioned within each of these vertically disposed slot-like cavities. Each such resilient member includes a second portion which extends outwardly from the rear face portion of such follower member. In this manner, a vertically disposed wedge-like element, between the rear wall of the cavity and the follower, can be engaged with the opposed outermost surface area of each such resilient element. This wedge-like element is a necessary component in this articulated coupling arrangement so that during service thereof such follower members and the male connection member can be urged in a forward direction. Consequently, the rear surface portion of the aperture formed in the outer end portion of such male connection member will, at all times, be maintained substantially in mating engagement with such pin member.

Other prior art type articulated coupling arrangements are also taught in U.S. Pat. No. 3,716,148 and Canadian Patent Number 1,231,078.

A problem common to all of the articulated coupling arrangements known to Applicants at the present time, is that they are all susceptible to extraneous foreign matter entering into the articulated connection component, where such foreign matter can be catastrophic. This would be the case, for example, if relative movement between the male connection member and the female connection member is inhibited during negotiations of a curve located in the track structure. Such a circumstance could cause a possible derailment.

SUMMARY OF THE INVENTION

The present invention provides a shroud apparatus for an articulated coupling arrangement which connects adjacent predetermined ends of a pair of railway cars together in a substantially semi-permanent fashion. Such shroud apparatus is instrumental in preventing the entrance of detrimental extraneous foreign material into at least a predetermined portion of a cavity located in the outer end portion of a female connection member of such articulated coupling arrangement. According to the present invention, such shroud apparatus includes a plate-like member which will be positioned above such articulated coupling arrangement in a location which will substantially prevent extraneous foreign material from entering into such predetermined portion of the cavity area disposed at such outer end portion of the female connection member. This plate-like member has a predetermined size and a predetermined shape. The predetermined shape of such plate-like member, when viewed from the top of the articulated coupling arrangement, is such that substantially all of the openings present in such predetermined portion of the cavity will be covered. The shroud apparatus also includes a means for removably securing such shroud apparatus to such articulated coupling arrangement at a predetermined location. Such securing means is engageable with both the shroud apparatus and the articulated coupling arrangement.

OBJECTS OF THE PRESENT INVENTION

It is, therefore, one of the primary objects of the present invention to provide a shroud apparatus for an articulated coupling apparatus which will substantially minimize extraneous foreign material which could interfere with the proper operation of such coupling arrangement from entering a cavity disposed on the outer end of the female connection member of such coupling arrangement.

Another object of the present invention is to provide a shroud apparatus for an articulated coupling arrangement which is rather simplistic in design.

Still another object of the present invention is to provide a shroud apparatus for an articulated coupling arrangement which can be either produced in a stamping operation or as a fabricated component.

Yet another object of the present invention is to provide a shroud apparatus for an articulated coupling arrangement which is relatively simple to install and which does not require the use of any special tools during the installation process.

A further object of the present invention is to provide a shroud apparatus for an articulated coupling arrangement which during the useful life thereof will require a minimum amount of maintenance be carried out thereon.

An additional object of the present invention is to provide a shroud apparatus for an articulated coupling arrangement which can be positioned such that it will not interfere with the normal operation of such coupling arrangement.

Still yet another object of the present invention is to provide a shroud apparatus for an articulated coupling arrangement which when properly installed will substantially minimize the chance of an undesirable derailment of a train consist due to foreign matter being lodged in the cavity thereby preventing the coupling arrangement making the necessary horizontal and vertical movements during operation of the train consist on curved and/or hilly portions of the track structure.

Yet a further object of the present invention is to provide a shroud apparatus for an articulated coupling arrangement which due to its simple design and ease of installation will not add significantly to the overall cost associated with such articulated coupling arrangement.

It is another object of the present invention to provide a shroud apparatus for an articulated coupling arrangement which can be rather easily retrofitted onto an existing articulated coupling arrangement and which will achieve all of the advantages provided thereby on new installations.

In addition to the above described objects and advantages of the present invention, various other objects and advantages of such shroud apparatus for an articulated coupling apparatus will become more readily apparent to those persons who are skilled in the railway coupler art from the following more detailed description of the invention, particularly, where such description is taken in conjunction with the attached drawings and with the appended claims.

BRIEF DESCRIPTION OF THE INVENTION

Figure 1:
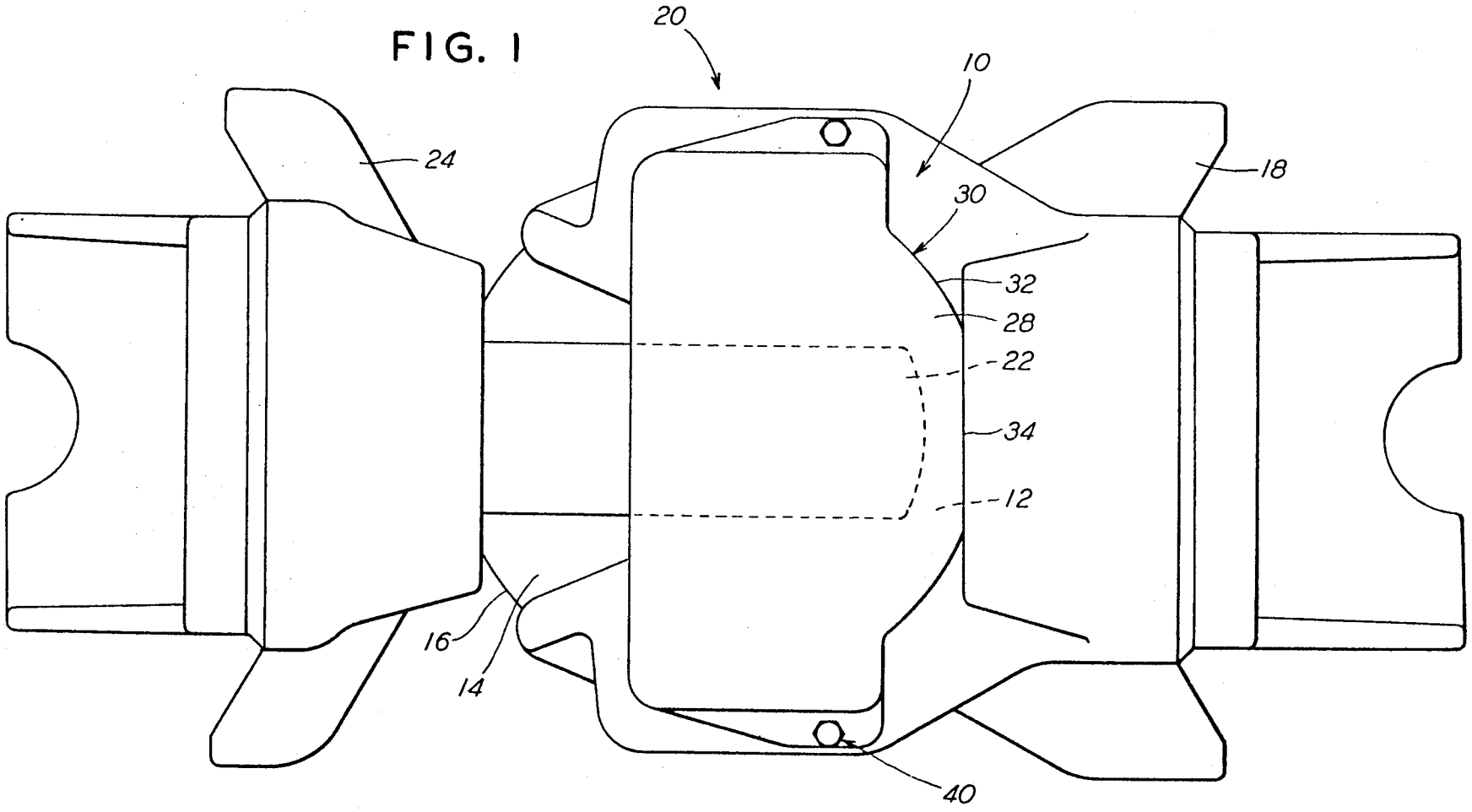
FIG. 1 is a top view of one present preferred shroud apparatus according to the present invention.

Prior to proceeding to the more detailed description of the shroud apparatus for an articulated coupling arrangement produced according to the present invention, it should be noted that throughout the several views illustrating such shroud apparatus, identical components, which have identical functions, have been identified, for the sake of clarity, with identical reference numerals.

Figure 2:
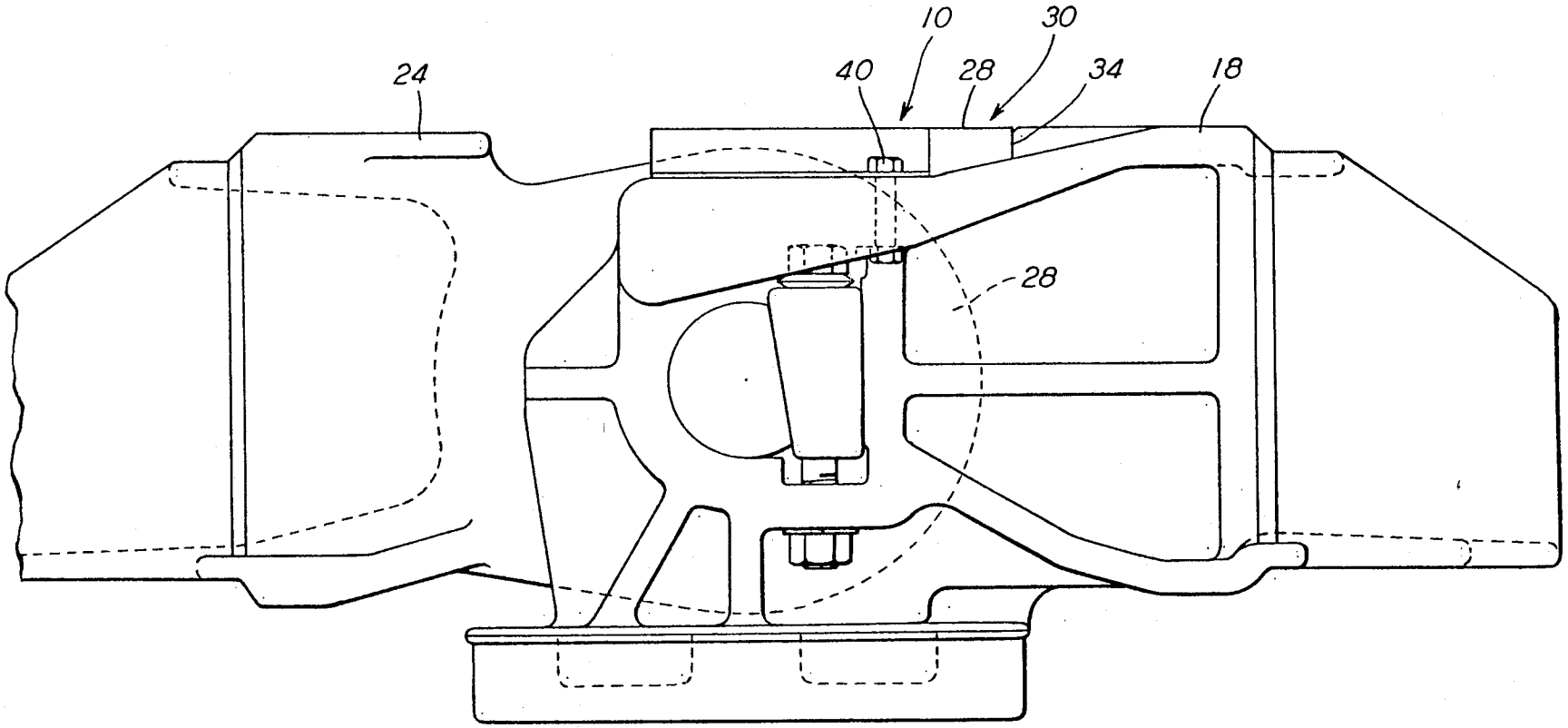
FIG. 2 is a side elevation view of the shroud apparatus illustrated in FIG. 1.
Figure 3:
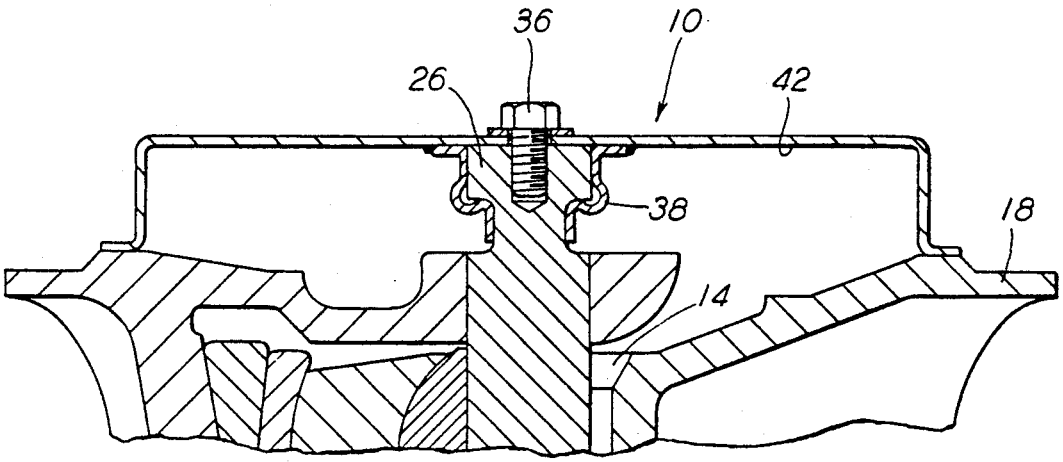
FIG. 3 is a view which illustrates an alternative shroud apparatus according to the present invention.

Now refer more particularly to FIGS. 1 through 3, which illustrate the presently preferred embodiment of the shroud apparatus, generally designated 10, produced according to this invention. Such shroud apparatus 10 is designed to substantially minimize the entrance of detrimental extraneous foreign material into at least a predetermined portion 12 of a cavity 14 which is located at an outer end 16 of a female connection member 18 of an articulated coupling arrangement, generally designated 20. The cavity 14 receives therein, an outer end 22 of a male connection member 24 which also forms a part of the articulated coupling arrangement 20, which is used to connect adjacent predetermined ends (not shown) of a pair of railway cars (not shown) together in a substantially semipermanent manner. Because these articulated coupling arrangements are operated in rather hostile environments, such foreign material can be stones, metal, etc. It is even conceivable for tools to be left on the car or coupling apparatus when repair and or other maintenance is being carried out which could subsequently fall into such cavity 14. Obviously, metal and/or tools can have a devastating affect on the proper operation of the coupling arrangement 20, if they prevent the male and female connection members 24 and 18, respectively, from moving relative to one another.

The shroud apparatus 10 includes a plate-like member, generally designated 30. The plate-like member 30 is positioned above and engageable with such articulated coupling arrangement 20 in a location which will substantially prevent the extraneous foreign matter from entering into such predetermined portion 12 of the cavity 14 formed in the outer end 16 of such female connection member 16. The plate-like member 30 has a predetermined size and a predetermined shape which are selected so that when the shroud apparatus 10 is secured to the articulated coupling arrangement 20, all openings to such predetermined portion 12 of the cavity 14 will be covered and closed to the entry of foreign matter.

A shroud securing means, generally designated 40, which is engageable with both the plate-like member 30 and the articulated coupling arrangement 20, is provided for removably securing such shroud apparatus 10 to a predetermined member of such articulated coupling arrangement 20.

The type of articulated coupling arrangement 20, to which the shroud apparatus 10 is to be secured, will normally determine the member to which such shroud apparatus will be secured to. Such member may be, for example, the male connection member 24, the female connection member 18, or a vertically disposed pin member 26 (FIG. 3).

In a presently preferred embodiment of the invention, the predetermined shape of such plate-like member 30 will include a raised portion 28. Such raised portion 28 of the shroud apparatus 10 will extend upwardly at least about 1.0 inch above a lowermost point of such shroud apparatus lo. This raised portion 28 on the plate-like member 30 enables both the male connection member 24 and the female connection member 18 to move relative to each other in each of a vertical plane and a horizontal plane without interference of such shroud apparatus 10 during in-track service of the articulated coupling arrangement 20.

In one form of the present invention, it will be preferred that such predetermined shape of the shroud apparatus 10 will include at least an arcuate portion 32 disposed in such raised portion 28 of the plate-like member 30. Further, such arcuate portion 32 in this embodiment will include a blunt nose portion 34. Particularly with regard to the form of the articulated coupling arrangement as illustrated, it will be also preferred that the predetermined portion of the cavity covered include at least the portion of such cavity adjacent to the back wall thereof.

When the shroud apparatus 10 is to be secured to either the male connection member 24 or the female connection member 18 of the presently preferred shroud, securing means 40 will preferably be at least two bolts 36. On the other hand, if the shroud apparatus 10 is to be secured to a vertically disposed pin member 26, such shroud securing means 40 can be at least one bolt 36 or a clamp 38 secured to a bottom surface 42 of the plate-like member 30, which clamps onto such vertically disposed pin member 26.

While a number of presently preferred embodiments of a shroud apparatus to minimize extraneous foreign matter from entering a cavity of an articulated coupling apparatus have been illustrated in the drawings and described above, it should be understood that persons who are skilled in the railway coupling art can make various other modifications and adaptations of the present invention without departing from the spirit and scope of the appended claims.

We claim:

1. A shroud apparatus which will substantially minimize detrimental extraneous foreign matter being able to enter into at least a predetermined portion of a cavity disposed at an outer end of a female connection member and which horizontally receives therein an outer end of a male connection member of an articulated coupling arrangement used to connect adjacent ends of a pair of railway cars together in a substantially semi-permanent manner, said shroud apparatus comprising:

(a) a plate-like member positionable above and engageable with such articulated coupling arrangement in a location which will substantially prevent such extraneous foreign matter from entering into such predetermined portion of such cavity formed on such outer end of such female connection member, such plate like member having a predetermined size and a predetermined shape such that when said shroud apparatus is secured in place, all openings to such predetermined portion of such cavity will be covered and closed to the entry of foreign matter;

(b) a shroud securing means engageable with both said plate-like member and such articulated coupling arrangement for removably securing said shroud apparatus to a predetermined member of such articulated coupling arrangement; and (c) means comprising at least one member to rigidly and positively maintain said plate-like member a predetermined vertical distance from adjacent portions of said female connection member and same male connection member.

2. A shroud apparatus for an articulated coupling arrangement, according to claim 1, wherein said predetermined member of such articulated coupling arrangement having said shroud apparatus secured thereto is one of such male connection members and such female connection members and a vertically disposed pin member.

3. A shroud apparatus for an articulated coupling arrangement, according to claim 2, wherein said shroud apparatus has a raised portion above its lower most point sufficient to permit the male and female connection members to move relative to each other in each of a vertical plane and horizontal plane without interference of such shroud apparatus.

4. A shroud apparatus for an articulated coupling arrangement, according to claim 3, wherein said raised portion of said shroud apparatus is at least about 1.0 inch above a lowermost point of said shroud apparatus.

5. A shroud apparatus for an articulated coupling arrangement, according to claim 4, wherein said predetermined shape of said shroud apparatus includes at least one arcuate portion in said raised portion.

6. A shroud apparatus for an articulated coupling arrangement, according to claim 5, wherein said arcuate portion of said plate-like member includes a blunt nose portion.

7. A shroud apparatus for an articulated coupling arrangement, according to claim 3, wherein said raised portion of said shroud apparatus is at least about 1.0 inch above a lowermost point of said shroud apparatus.

8. A shroud apparatus for an articulated coupling arrangement, according to claim 7, wherein said predetermined shape of said shroud apparatus includes at least one arcuate portion in said raised portion.

9. A shroud apparatus for an articulated coupling arrangement, according to claim 2, wherein said predetermined member of such articulated coupling arrangement is a female connection member and said shroud securing means is at least two bolts.

10. A shroud apparatus for an articulated coupling arrangement, according to claim 9, wherein said predetermined member of such articulated coupling arrangement having said shroud apparatus secured thereto is one of such male connection member and such female connection member and a vertically disposed pin member.

11. A shroud apparatus for an articulated coupling arrangement, according to claim 2, wherein said predetermined member of such articulated coupling arrangement is a male connection member and said shroud securing means is at least two bolts.

12. A shroud apparatus for an articulated coupling arrangement, according to claim 1, wherein said shroud apparatus covers substantially an entire surface area of such cavity.

13. A shroud apparatus for an articulated coupling arrangement, according to claim 1, wherein said predetermined portion of such cavity is adjacent a back wall thereof.

14. A shroud apparatus which will substantially minimize detrimental extraneous foreign matter being able to enter into at least a predetermined portion of a cavity disposed at an outer end of a female connection member and which horizontally receives therein an outer end of a male connection member of an articulated coupling arrangement used to connect adjacent ends of a pair of railway cars together in a substantially semi-permanent manner, said shroud apparatus comprising:

(a) a plate-like member positionable above and engageable with such articulated coupling arrangement in a location which will substantially prevent such extraneous foreign matter from entering into such predetermined portion of such cavity formed on such outer end of such female connection member, such plate like member having a predetermined size and a predetermined shape such that when said shroud apparatus is secured in place, all openings to such predetermined portion of such cavity will be covered and closed to the entry of foreign matter;

(b) a shroud securing means engageable with both said plate-like member and such articulated coupling arrangement for removably securing said shroud apparatus to a predetermined member of such articulated coupling arrangement; and (c) wherein said predetermined member of such articulated coupling arrangement having said shroud apparatus secured thereto is vertically disposed pin member and said shroud securing means is a clamp secured to a bottom surface of said plate-like member which clamp engages such pin member.

15. A shroud apparatus which will substantially minimize detrimental extraneous foreign matter being able to enter into at least a predetermined portion of a cavity disposed at an outer end of a female connection member and which horizontally receives therein an outer end of a male connection member of an articulated coupling arrangement used to connect adjacent ends of a pair of railway cars together in a substantially semi-permanent manner, said shroud apparatus comprising:

(a) a plate-like member positionable above and engageable with such articulated coupling arrangement in a location which will substantially prevent such extraneous foreign matter from entering into such predetermined portion of such cavity formed on such outer end of such female connection member, such plate like member having a predetermined size and a predetermined shape such that when said shroud apparatus is secured in place, all openings to such predetermined portion of such cavity will be covered and closed to the entry of foreign matter;

(b) a shroud securing means engageable with both said plate-like member and such articulated coupling arrangement for removably securing said shroud apparatus to a predetermined member of such articulated coupling arrangement; and (c) wherein said predetermined member of such articulated coupling arrangement having said shroud apparatus secured thereto is a vertically disposed pin member and said shroud securing means includes at least one bolt.

16. A shroud apparatus which will substantially minimize detrimental extraneous foreign matter being able to enter into at least a predetermined portion of a cavity disposed at an outer end of a female connection member and which horizontally receives therein an outer end of a male connection member of an articulated coupling arrangement used to connect adjacent ends of a pair of railway cars together in a substantially semi-permanent manner, said shroud apparatus comprising:

(a) a plate-like member positionable above and engageable with such articulated coupling arrangement in a location which will substantially prevent such extraneous foreign matter from entering into such predetermined portion of such cavity formed on such outer end of such female connection member, such plate like member having a predetermined size and a predetermined shape such that when said shroud apparatus is secured in place, all openings to such predetermined portion of such cavity will be covered and closed to the entry of foreign matter;

(b) a shroud securing means engageable with both said plate-like member and such articulated coupling arrangement for removably securing said shroud apparatus to a predetermined member of such articulated coupling arrangement;

(c) said shroud apparatus is secured to one of such male connection member, such female connection and a vertically disposed pin member;

(d) said shroud apparatus has a raised portion at least about one inch above its lowermost point to permit the male and female connection members to move relative to each other in each of a vertical plane and a horizontal plane without interference of said shroud apparatus;

(e) said predetermined shape of said shroud apparatus includes at least one arcuate portion in said raised portion; and (f) said predetermined portion of such cavity is adjacent a back wall thereof and said arcuate portion in said raised portion of said shroud apparatus extends toward such back wall of such cavity.

* * * * *